US005325752A

United States Patent [19]

Bory

[11] Patent Number: 5,325,752

[45] Date of Patent: Jul. 5, 1994

[54] CUTTER INSTRUMENT FOR PRECISION CUTTING OF RECTANGULAR SHAPES FROM A CORRUGATED CARDBOARD SHEET

[75] Inventor: William H. Bory, Baltimore, Md.

[73] Assignee: Chesapeake Corporation, Baltimore, Md.

[21] Appl. No.: 896,780

[22] Filed: Jun. 10, 1992

[51] Int. Cl.[5] ..... B26D 1/04

[52] U.S. Cl. ..... 83/468.4; 83/471.2; 83/614

[58] Field of Search ..... 83/614, 620, 468.4, 83/468.1, 39, 471.2, 36, 455, 704; 269/291

[56] References Cited

U.S. PATENT DOCUMENTS

| | | | |
|---|---|---|---|
| 179,645 | 7/1876 | Cassidy | 83/614 |
| 289,594 | 12/1883 | Ziger | 83/614 X |
| 2,409,203 | 10/1946 | Gale | 83/459 |
| 3,130,622 | 4/1964 | Eno | 83/529 |
| 3,213,736 | 10/1965 | Keeton | 83/455 |
| 3,354,769 | 11/1967 | Abramson et al. | 83/614 X |
| 3,513,744 | 5/1970 | Hershberger | 83/520 |
| 3,527,131 | 9/1970 | Ellerin | 83/522 |
| 4,590,834 | 5/1986 | Sobel | 83/455 |
| 4,641,556 | 2/1987 | Vigneron et al. | 83/36 |
| 4,662,258 | 5/1987 | Mood | 83/455 |
| 4,738,177 | 4/1988 | Jones, III et al. | 83/455 |
| 4,858,507 | 8/1989 | Evans et al. | 83/455 |
| 5,086,680 | 2/1992 | Johnson | 83/614 X |
| 5,127,294 | 7/1992 | Mohr | 83/468.1 X |
| 5,146,823 | 9/1992 | Holmes | 83/56 |

*Primary Examiner*—Richard K. Seidel
*Assistant Examiner*—Kenneth E. Peterson
*Attorney, Agent, or Firm*—Lowe, Price, LeBlanc & Becker

[57] ABSTRACT

A cutter instrument for precision cutting of a corrugated sheet into a precision cut square for edge crush testing is disclosed. The cutter includes a base plate and a pair of cutting blades slidably mounted to the base plate for cutting movement in a direction parallel to a first guide rail. Positioning of the corrugated sheet against the first guide rail allows the sheet to be cut into a longitudinal strip of predetermined precise width. A pair of second guide rails spaced from each other by the predetermined width allows the strip to be rotated 90° and positioned between the second guide rails and respective abutting contact therewith. Movement of the cutter blades along the cutting path completes the cutting of the strip into a precise square.

9 Claims, 3 Drawing Sheets

CUTTER INSTRUMENT FOR PRECISION CUTTING OF RECTANGULAR SHAPES FROM A CORRUGATED CARDBOARD SHEET

TECHNICAL FIELD

The present invention relates generally to paper cutting and, more particularly, to a cutter instrument for precision cutting of square shapes of corrugated paperboard from sheet stock to conduct edge crush testing.

BACKGROUND ART

Corrugated cardboard is commonly used in the manufacture of shipping cartons having a wide variety of uses. The manufacturing of corrugated cardboard and the manufacturing of the cartons themselves are both well known and form no part of the present invention. However, in the manufacture of corrugated cartons, it is customary to determine the compression strength of the corrugated carton by edge crush testing of precision cut samples that are typically of square or rectangular dimensions. Heretofore, such samples were cut by hand, such as with a razor knife or saw, or formed with a die.

Such prior art methods are not completely reliable since the cut, and the precision thereof, varies with the manual skill of the cutter. If the resulting cut is not square, i.e., the edges are not parallel or the cut edge itself is bevelled, it will then be difficult to conduct a reliable crush test.

It is accordingly one object of the invention to obtain precision cut samples of corrugated cardboard to achieve reliable edge crush testing.

Another object is to provide a cutter for obtaining single or multiple precision cut samples of cut corrugated material.

Still another object is to provide a precision cutter which is portable, safe, easy to use, and does not utilize complex cutting mechanisms.

SUMMARY OF THE INVENTION

A cutter instrument for precision cutting of a sheet object into a precision cut sample of predetermined dimensions, in accordance with the present invention, comprises a support base means for supporting the sheet object and cutting means on the support base means for cutting the precision cut sample from the sheet. The cutting means includes at least one pair of cutting edges which are substantially parallel with and spaced a predetermined distance from each other to cut the object. The cutting means is mounted to the base means through a bearing means having smooth precision bearing surfaces for directing the movement of the cutting means along the base to obtain precision cutting. First guiding means is mounted on the base means and includes a guide surface extending in the direction of movement of the cutting means. The sheet object is positioned against the first guiding means for predetermined alignment with the cutting means. Second guiding means is mounted on the base means and extends perpendicular to the moving direction of the cutting means. The second guiding means includes a guide surface against which the sheet object is positioned for predetermined alignment with the cutting means. At least a pair of cutting grooves are formed in the base means at locations respectively corresponding to the respective paths of movement of the cutting blades to thereby respectively receive the cutting edges of the blades.

More specifically, the support base means is a flat plate having an upwardly directed surface formed with a first key groove extending the length of the plate. The first guiding means is a rectangular bar mounted in the groove. A side wall of the bar projects upwardly from the base surface, perpendicular thereto, to define a first guiding edge against which the sheet object is to be positioned for alignment with the cutting blades in a first cut.

A wide shallow recess is formed in the upwardly directed surface both parallel to and spaced from the first guiding edge. A plurality of metal gauge plates are bolted to the base within the shallow wide recess such that their upper surfaces are flush with the upwardly directed surface of the base. These plates define a back plate on which the sheet object being cut is positioned and supported during the cutting process. The back plate defined by the upper surfaces of the gauge plates are respectively bounded along their longitudinal edges by the cutting grooves through which the cutting blades respectively travel while preferably contacting the side edges of the gauge plates. This contact helps maintain the cutting blades in predetermined alignment with each other and perpendicular to the top and bottom surfaces of the corrugated material to ensure a square cut edge.

The second guiding means preferably includes a pair of parallel guide members respectively mounted in key grooves formed in the base upwardly directed surface. Each of the second guide members includes vertical side walls projecting upwardly from the base surface. The inner vertical walls which face each other are preferably spaced apart by a distance corresponding to the spacing between the cutting blades. In this manner, after the sheet object is cut by the blades in a first cut while being positioned against the first guide member, the resulting cut strip is then inserted between the second guide members so as to extend between the cutting grooves for a second cut into the precision cut sample.

The cutting means comprises a precision cut block of rectangular dimensions having shallow recesses formed in side walls thereof adopted to respectively receive the cutting blades which present cutting edges projecting downwardly from the block. A pair of clamping plates are respectively bolted to the side walls of the blade mounting block to securely clamp the blades within the slot. The blade mounting block is connected through a top plate to a pair of slide blocks also mounted to the bottom surface of the top plate in spaced relation to each other. The slide blocks include, in inward facing vertical side walls, respectively, a groove adapted to slidingly engage a pair of bearing tracks mounted to the base plate parallel to the first guide member. In this manner, the cutting block slides along the base plate upper surface via the aforesaid sliding engagement while the cutting blades travel through the cutting grooves in proper spaced alignment with each other.

To ensure that each cut edge is precisely square with the top and bottom surfaces of the corrugated board, each blade is a flat blade on one side. It is this flat blade which faces toward the precision cut sample with the bevelled cutting edge, on the opposite side of the blade, facing the resulting scrap material being cut.

The above and still further objects, features and advantages of the present invention will become apparent upon consideration of the following detailed description of a specific embodiment thereof, especially when taken in conjunction with the accompanying drawings.

BEST MODE FOR CARRYING OUT THE INVENTION

Figures 1, 6:
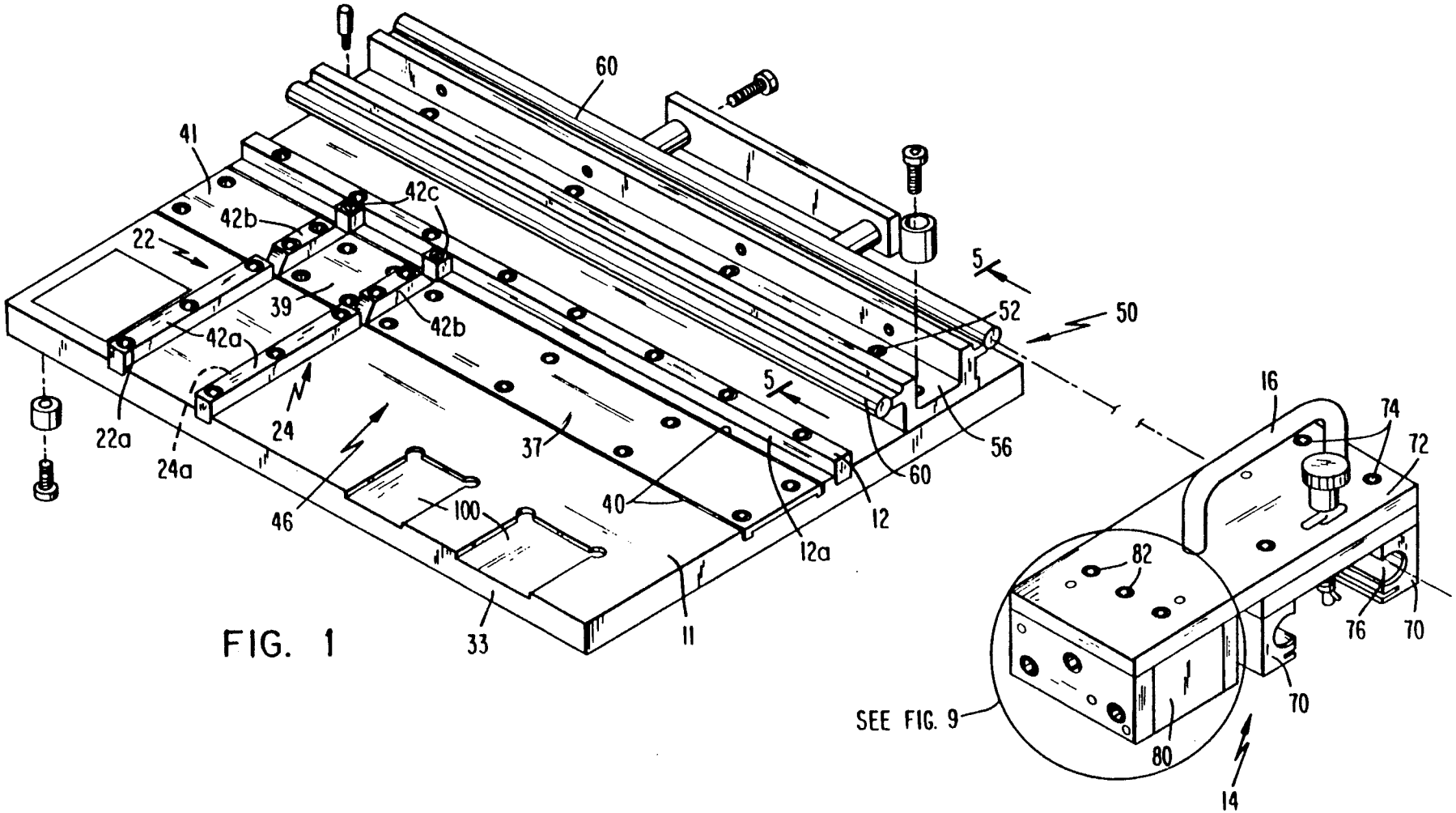
FIG. 1 is an exploded perspective view of a precision sample cutter in accordance with the present invention.
FIG. 6 is a perspective view of the cutting block assembly and slide mechanism thereof utilized in this invention.
Figure 4:
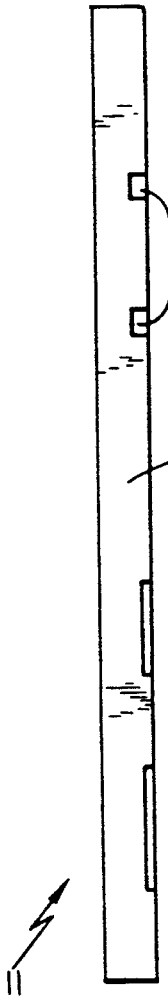
FIG. 4 is a side elevational view of the cutter base plate with the guide rails and cutter block assembly removed for clarity.

FIG. 1 is an illustration of a cutter instrument 10 preferably used for cutting a sheet of corrugated cardboard (not shown) into a precision cut square useful for edge crush testing to determine the compression strength of a corrugated box. In operation, one edge of the corrugated sheet is positioned on a base plate 11 against a first guide rail 12. As slight manual pressure is applied to the sheet in the direction of the first guide rail 12 to maintain positive contact, a cutting block assembly 14 is manually slid via gripping handle 16 from left to right in FIG. 1 to enable a pair of cutting blades 18 and 20 to cut from the sheet a strip having a precision cut width W defined by the distance between the cutting blades. The resulting scraps respectively formed adjacent the strip (i.e., between guide rail 12 and blade 20, and outwardly from blade 18) are discarded. This strip is then positioned between a pair of second guide rails 22 and 24 which are located at one end of the base plate 11 and which have parallel opposing faces 22*a* and 24*a*, respectively, spaced from each other by the precise distance W. The strip is now positioned between the second guide rails with the longitudinal cut edges thereof in abutting contact with the surfaces of the second guide rails. The cutting block assembly 14, having been returned to the home position (i.e., upper left hand corner in FIG. 1), is once again slid from left to right to cut the strip into a square having nominal precision cut dimensions of W×W.

Figure 2:
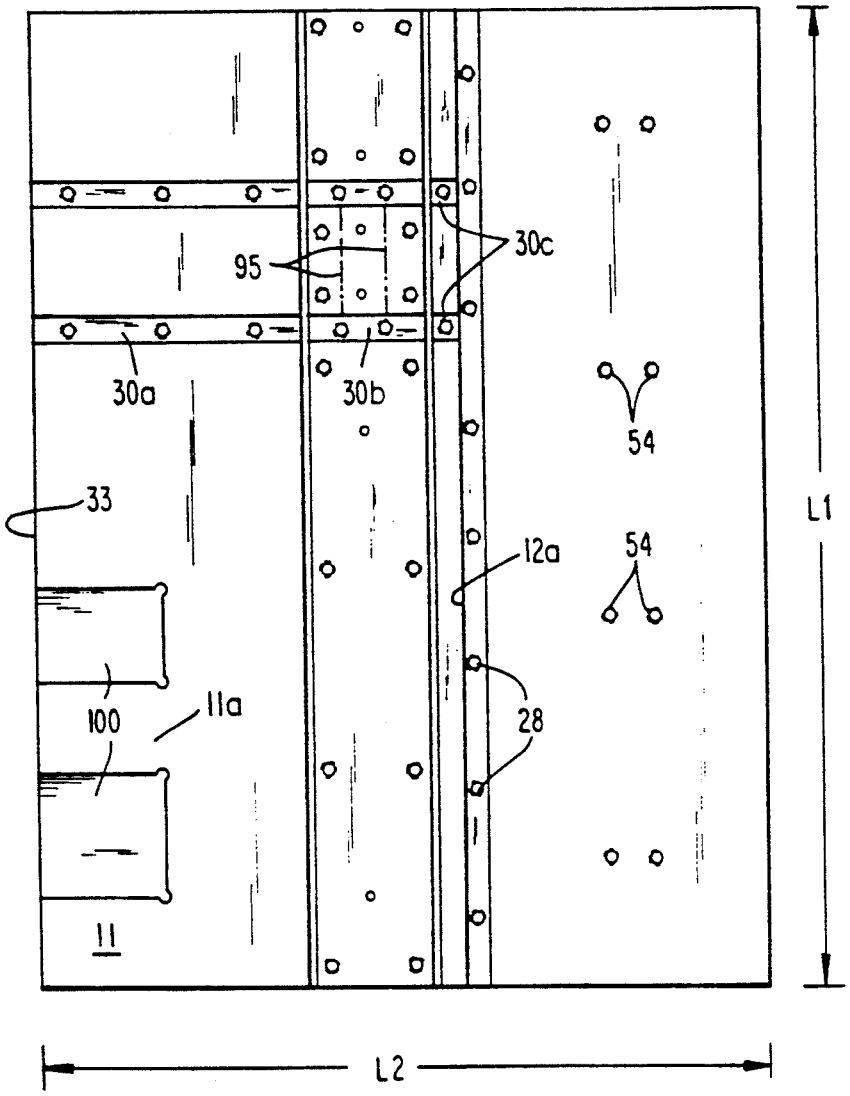
FIG. 2 is a top plan view of the cutter base plate.
Figure 3:
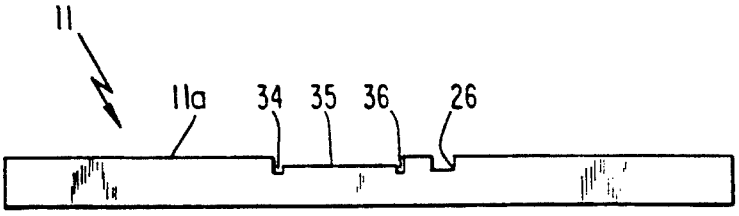
FIG. 3 is a front elevational view of the cutter base plate with the guide rails and cutter block assembly removed for clarity.

The base plate 11 is rectangular in plan view having a lengthwise longitudinal dimension L1 and a shorter width-wise lateral dimension L2. With reference to FIGS. 2 and 3, a channel 26 of rectangular cross-section is formed in the upwardly directed flat surface 11*a* of the base plate 11 to extend longitudinally the full length of the plate. The first guide rail 12 is mounted within the channel 26 with bolts 28 and includes a vertical side wall 12*a* projecting upwardly from the base plate surface 11*a* in perpendicular relation thereto.

The parallel second guide rails 22,24 are each comprised of three rail sections 30*a*, 30*b* and 30*c* of identical rectangular cross-section but of different lengths which are respectively bolted into parallel rectangular channels 32 (FIG. 2) intersecting the first guide rail 12 at one end of the channels and extending transversely to intersect one of the longitudinal edges 33 of the base plate 11 at their opposite channel ends. As mentioned above, these second guide rails 22,24 are respectively formed with the vertical guide walls 22*a*,24*a* facing towards each other and spaced the predetermined distance W apart which corresponds to the precise spacing between the cutting edges of the cutting blades 18,20.

A shallow recess 35 of rectangular cross section (FIG. 3) is formed in the base plate upper surface 11*a* and extends longitudinally to intersect the laterally extending base plate edge at opposite ends thereof. A series of flat anvil plates 37,39 and 41 are bottled within recess 35 to define a hard flat surface between the cutting blades 18 and 20 against which the material being precision cut is disposed.

A pair of cutting grooves 34 and 36 respectively extend along the aligned vertical longitudinal edges 40 defined by the anvil plates 37–41 to enable the cutting blades 18,20 to project downwardly from the cutting block assembly 14 and below the upper surfaces 43 (coplanar with base plate surface 11*a*) of the anvil plates 37–41 to ensure accurate cutting of the sheet object. Advantageously, the individual rail sections 42*a*, 42*b* and 42*c* of each second guide rail 22,24 are correspondingly spaced from each other to avoid intersecting the cutting grooves 34,36 which therefore extend continuously between the opposite lateral edges of the base plate 11.

It will be appreciated that the opposing guide edges 22*a*,24*a* of the respective second guide rails 22,24 are precisely parallel to each other and square with the guide edge 12*a* of the first guide rail 12. Likewise, the outer side walls of the second guide rails 22,24, respectively, are both perpendicular to the upwardly directed surface 11*a* of the base plate 11 and the first guide surface 12*a*. The outer guide surface of the second guide rail 24 (spaced closest to the middle of the base plate 11) defines with the first guide surface 12*a* a first cutting zone 46 extending between these square surfaces and those remaining portions of the longitudinal and lateral base plate edges located between these rails. The sheet object, preferably but not necessarily of rectangular configuration, is adapted to be positioned in abutting contact with the first guide surface 12*a* to enable movement of the cutting block assembly 14 in a first cutting stroke so as to form the longitudinal rectangular strip of precise width W, as aforesaid.

Figure 5:
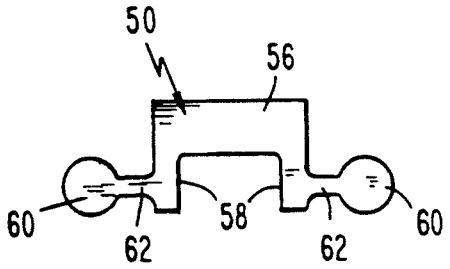
FIG. 5 is a sectional view taken along the line 5—5 of FIG. 1 of a slide track on the cutter base plate for providing sliding support for a cutting block assembly.

FIG. 5 is an illustration of a slide track 50 which is mounted with bolts 52 to pairs of through holes 54 located outwardly adjacent the first guide rail 12 (i.e. to the right of the first guide rail in FIG. 2) to extend parallel to the first guide surface 12*a* and the cutting grooves 24,26. The slide track 50 includes an elongate central mounting base section 56 formed with through holes at locations corresponding to the bolt receiving holes 54 in the base plate 11. A pair of slide mounting arms 58 project upwardly from the longitudinal edges of the mounting section 56, perpendicular thereto, to respectively define a bearing track 60 of cylindrical cross-section separated from the associated upright arm with a thin web section 62. In this manner, each track 60 is suspended above the base plate upper surface 11*a* in parallel relation to the first guide surface 12*a* and the cutting grooves 24,26.

The cutting block assembly 14, as best depicted in FIG. 6, comprises a pair of slide blocks 70 mounted in spaced relation to each other to the bottom surface of a top plate 72 by means of screws 74 passing downwardly through the top plate into the upper surface of each slide block. Each slide block 70 is of rectangular cross-section to define, in a vertical inward facing surface thereof (opposing a like surface of the other slide block), a groove 76 extending along the entire inner surface to intersect the front and rear faces of the slide block. Each groove 76 is formed with a cross-section corresponding to that of the cylindrical track 60 and is adapted to receive a corresponding one of the tracks and be supported thereby for sliding movement along the base plate 11. Each slide block 70 is dimensioned so that the cutting block assembly 14 is solely supported on the base plate 11 by means of the aforesaid slide track arrangement.

Figure 7:
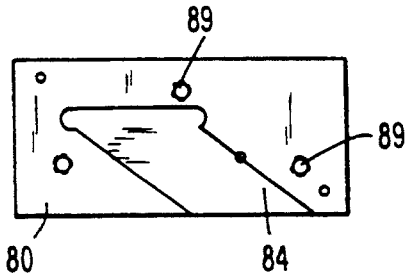
FIG. 7 is a side plan view of the cutting block.
Figure 8:
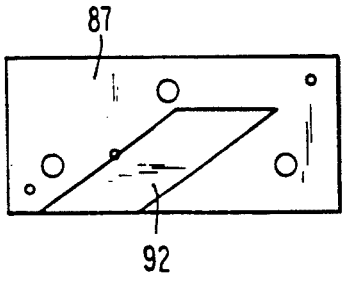
FIG. 8 is a side plan view of the clamping plate attached to the cutting block to clamp a cutting blade therebetween.
Figure 9:
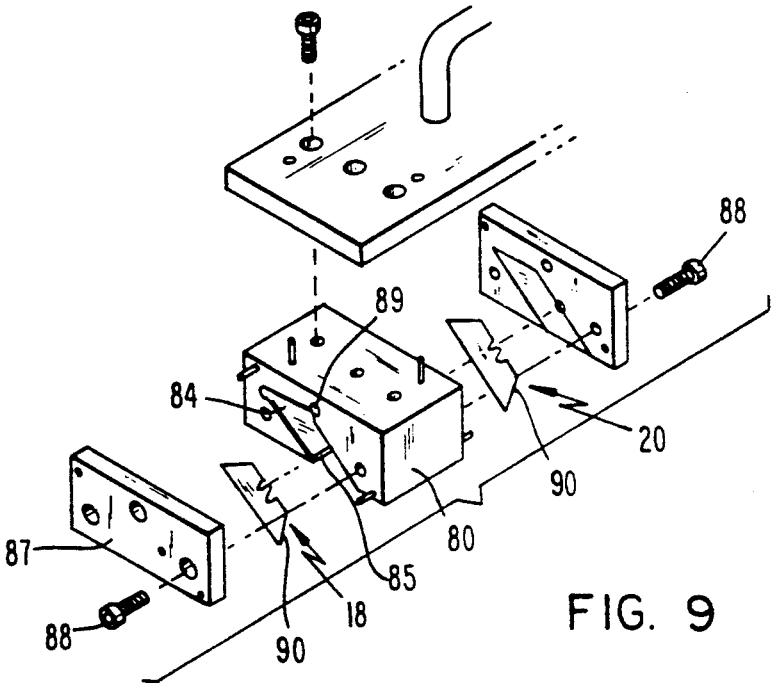
FIG. 9 is an exploded perspective view of the cutting block assembly.

With reference to FIGS. 7, 8 and 9, the cutting block assembly 14 further comprises a cutter blade holder 80 which is also bolted to the top plate 72 by means of screws 82 passing through the top plate into the upper surface of the block adjacent the innermost ones of slide blocks 70. The cutter blade holder 80 is of rectangular cross-section and formed with a pair of parallel vertical sides each containing a blade mounting recess 84 having the configuration depicted in FIGS. 7 and 9. Cutting blades 18,20 are respectively disposed in each recess 84 and secured therein by means of a pin 85 and a clamping plate 87 bolted to the associated side face of the holder 80 with screws 88 received in threaded bores 89. A recess 92 formed in each clamping plate 87 (FIG. 8) receives a portion of each blade 18,20 in cooperation with the opposing recess 84. Each cutting blade 18,20 has a cutting edge 90 extending downwardly from the cutting block as depicted in FIG. 9. Handle 16 is attached to the top surface of the top mounting plate 72 to enable manual sliding of the cutting block assembly 14 along the slide tracks 60 in the aforesaid manner.

With the foregoing construction of the invention, the cutting edges 90 are set to a predetermined spacing W corresponding to the spacing between the cutting grooves 34,36 through which the exposed blade edges 90 travel during sliding and cutting movement. The predetermined, precision distance W between cutting edges 90 is advantageously maintained via sliding, scissors-like cutting contact between the blade cutting edges and the longitudinal edges of the anvil plates 37–41. In this manner, a sheet object positioned between the cutting grooves 34 and 36 on the anvil plates 37–41 is precisely cut into a longitudinal strip of precision width W as the cutting block assembly 14 is slid along the tracks 60 as aforesaid. After cutting, this longitudinal strip is positioned between the second guide rails 22,24 for cross-cutting into a precision cut square suitable for edge crush testing.

Referring again to FIG. 1, guide lines 95 formed between rails 22,24 in parallel relation to the cutting blades 18,20 may be formed a predetermined distance from the blades. After the first cut is made, one of the cut edges may be aligned with one of lines 95 so that the second cut results in a sample having one dimension defined between cutting blade 18 and said one of the lines 95.

Base plate 11 may also be formed with rectangular recesses 100, in surface 11*a* thereof, having dimensions corresponding to selected ones of the precision cut dimension to enable verification of the accuracy of the cut by placement of the cut sample into the recess.

While there has been described and illustrated one specific embodiment of the invention, it will be clear that variations in the details of the embodiment specifically illustrated and described may be made without departing from the true spirit and scope of the invention as defined in the appended claims.

I claim:

1. A cutter instrument for precision cutting a sheet object into a precision cut sample of predetermined dimensions, comprising:

a support base for supporting said sheet object for cutting;

a cutter on said support base and including at least one pair of cutting blades being substantially parallel with and spaced a predetermined precision distance from each other for cutting said precision cut sample from said sheet object;

a bearing arrangement mounted on said support base for movably mounting said cutter to said support base and for directing the movement of said cutter along said support base to obtain said precision cut from said sheet object;

a first guide mounted on said support base and including a guide surface extending in the direction of movement of said cutter, said sheet object being positioned with said first guide for predetermined alignment with said cutter;

a second guide including a second guide rail mounted on said support base and extending perpendicular to the moving direction of said cutter and including a guide surface against which said sheet object is positioned for further predetermined alignment with said cutter; and at least a pair of cutting grooves in said support base at locations respectively corresponding to the respective paths of movement of said cutting blades to thereby respectively receive the cutting edges of said cutting blades, wherein said cutting grooves extend through the second guide rail so as to define an uninterrupted, continuous cutting path through which the cutting blades respectively move through the second guide rail.

2. The cutter of claim 1, wherein said first guide includes a first guide rail extending parallel to a lengthwise axis of the support base.

3. The cutter of claim 2, wherein said second guide includes said second guide rail extending perpendicular to the first guide rail, said first and second guide rails each having vertical faces defining guide surfaces which are perpendicular and square to each other to define a cutting zone with a portion of the support base extending therebetween, whereby said sheet object is adapted to be positioned against the first guide rail for a first cut and then against the second guide rail within the cutting zone for a second cut to form a precision cut sample.

4. The cutter of claim 3, wherein said second guiding guide includes another second guide rail positioned parallel to a first of said second guide rails.

5. The cutter of claim 4, wherein said pair of second guide rails respectively have opposing vertical walls defining second guide surfaces extending perpendicular to the first guide surface and spaced from each other by a precise distance corresponding to the precision distance between said cutting blades.

6. The cutter of claim 5, wherein said cutting means is slidably mounted to said base means through said bearing means.

7. The cutter of claim 6, wherein said bearing arrangement includes a mounting panel secured to the base to extend parallel to the first guide rail and adjacent thereto outside the cutting zone, a pair of mounting arms respectively extending upwardly from the mounting panel along longitudinal edges thereof, and a track formed at the upper end of each mounting arm and suspended above the support base via a connecting web.

8. The cutter of claim 7, wherein said cutter includes a pair of slide blocks respectively formed with a slide channel having a cross-section corresponding to the cross-section of the tracks for interfitting sliding engagement therewith; and a cutting block including means for clamping said cutting blades to said cutting block so that cutting portions of each blade project downwardly from the cutting block for reception in said cutting grooves, respectively.

9. The cutter of claim 8, wherein said cutting block is formed with a pair of blade receiving recesses respectively in parallel side faces thereof, and said clamping means including clamping blocks secured to the side faces of the cutting block to clamp the blades therebetween.

* * * * *